US008591663B2

(12) United States Patent
Remark et al.

(10) Patent No.: US 8,591,663 B2
(45) Date of Patent: Nov. 26, 2013

(54) CORROSION PRODUCT CHEMICAL DISSOLUTION PROCESS

(75) Inventors: John Remark, Lynchburg, VA (US); Sidney Jones, Lynchburg, VA (US); Ray Beatty, Lynchburg, VA (US); Sarah Evans, Lynchburg, VA (US)

(73) Assignee: Areva NP Inc, Lynchburg, VA (US)

( * ) Notice: Subject to any disclaimer, the term of this patent is extended or adjusted under 35 U.S.C. 154(b) by 506 days.

(21) Appl. No.: 12/625,778

(22) Filed: Nov. 25, 2009

(65) Prior Publication Data

US 2011/0120497 A1 May 26, 2011

(51) Int. Cl.

| | |
|---|---|
| ***B08B 7/00*** | (2006.01) |
| ***C23G 1/02*** | (2006.01) |
| ***B08B 3/00*** | (2006.01) |
| *G21F 9/00* | (2006.01) |
| *G21C 1/00* | (2006.01) |

(52) U.S. Cl.
USPC ..... 134/19; 134/2; 134/22.19; 134/26; 134/28; 134/41; 588/20; 422/159

(58) Field of Classification Search
USPC ..... 134/1, 19, 2, 22.19, 26, 28, 41; 588/20; 422/159
See application file for complete search history.

(56) References Cited

U.S. PATENT DOCUMENTS

| | | | | |
|---|---|---|---|---|
| 3,873,362 | A | 3/1975 | Mihram et al. | |
| 5,523,513 | A | 6/1996 | Milner | |
| 5,564,105 | A * | 10/1996 | Alvino et al. | 588/20 |
| 5,585,531 | A | 12/1996 | Barker et al. | |
| 5,587,025 | A * | 12/1996 | Jevec et al. | 148/274 |
| 5,601,657 | A * | 2/1997 | Baum | 134/3 |
| 5,752,206 | A * | 5/1998 | Frink et al. | 588/20 |
| 5,841,826 | A | 11/1998 | Rootham et al. | |
| 5,960,368 | A | 9/1999 | Pierce et al. | |
| 6,335,475 | B1 * | 1/2002 | Nagase et al. | 588/18 |
| 6,444,276 | B2 | 9/2002 | Bertholdt | |
| 6,855,208 | B1 * | 2/2005 | Soyama | 134/16 |
| 6,865,244 | B2 | 3/2005 | Meseth | |
| 7,410,611 | B2 * | 8/2008 | Salbilla | 422/22 |
| 2004/0129295 | A1 * | 7/2004 | Lovetro et al. | 134/3 |
| 2006/0041176 | A1 * | 2/2006 | Enda et al. | 588/320 |
| 2006/0065212 | A1 * | 3/2006 | Remark et al. | 122/379 |
| 2007/0153957 | A1 | 7/2007 | Gely et al. | |
| 2009/0118560 | A1 | 5/2009 | Jones et al. | |
| 2009/0183694 | A1 * | 7/2009 | Remark et al. | 122/396 |

OTHER PUBLICATIONS

"Tank Waste Retrieval, Processing and On-site Disposal at Three Department of Energy Sites: Final Report" National Research Council (2006) ISBN 978-0-309-10170-7 Chapters III and IX.

* cited by examiner

*Primary Examiner* — Michael Kornakov
*Assistant Examiner* — Katelyn Whatley
(74) *Attorney, Agent, or Firm* — Davidson, Davidson & Kappel, LLC

(57) ABSTRACT

A method for removing corrosion products from a system, the method including: adjusting the system temperature to between 115° F. to 212° F.; injecting a cleaning dissolution solvent into the system; injecting a gas into the system after the system is filled with the cleaning dissolution solvent; the gas mixing with the solvent in the system; draining the solvent from the system after a predetermined period of time of dissolution; injecting a passivation composition into the system; injecting a gas into the system, the gas mixing the passivation composition; draining the system of the composition after a predetermined period of time of passivation; rinsing the system with a low volume solution; and rinsing the system at with a full volume solution.

23 Claims, 1 Drawing Sheet

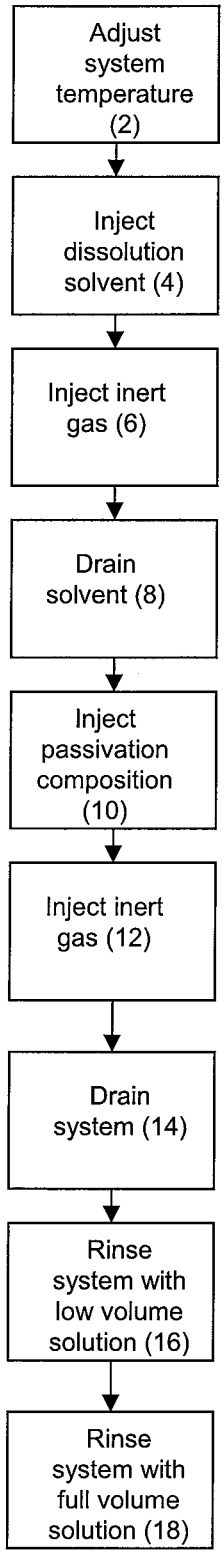
Adjust system temperature (2)
Inject dissolution solvent (4)
Inject inert gas (6)
Drain solvent (8)
Inject passivation composition (10)
Inject inert gas (12)
Drain system (14)
Rinse system with low volume solution (16)
Rinse system with full volume solution (18)

CORROSION PRODUCT CHEMICAL DISSOLUTION PROCESS

BACKGROUND

During operation of nuclear reactors, debris builds up in the system piping, tanks, heat exchangers and such (hereinafter "the system"). This build up can include sludge, scale, deposits and corrosion products or other metallic species. These deposits may or may not be contaminated with radioisotopes. These deposits are harmful to the system's components or tanks and must be removed. There are numerous chemical processes that may be applied for the removal of the material build up. These chemical processes vary in chemical formulation, application methodology and efficiency. The current state of the art chemical processes utilized for the dissolution and mobilization of the corrosion products and sludge build up produces large waste volumes which are difficult to treat and ultimately to dispose of. Typically the waste material is a liquid, however, it may be condensed into a very concentrated liquid that needs to be maintained at higher temperatures in order to remain in a liquid state. The large volumes of liquid waste require treatment prior to disposal and must be transported to the disposal site. The liquid wastes typically contain chelating agents and/or organics that require stabilization in order to meet State and/or U.S. Federal disposal guidelines, increasing the disposal difficultly and expense. Generation of these large volumes of liquid waste typically requires an environmental permit to be filed with States Regulatory Agencies.

There are several processes that utilize chemicals to remove sludge, deposits, scale, corrosion products or other complexed metal ions. Corrosion product removal processes include Chemical Oxidation Reduction Decontamination (CORD); Low Oxidation State Metal Ions (LOMI); and CAN-DEREM. Scale or deposit removal process typically contains EDTA (ethylenediamine tetraacetic acid). Scale or deposit removal processes include EDTA based steam generator cleaning proprietary solutions such as EPRI SGOG and Advanced Scale Conditioning Agents (ASCA). Each of these processes requires a specific application temperature to efficiently remove the sludge materials and generates process specific liquid wastes which are difficult to stabilize and expensive to handle.

As discussed above, a problem with the current corrosion product chemical dissolution processes is that they generate large quantities of chemical liquid waste, which is difficult to dispose of due primarily to the presence of the chelating agent such as EDTA. Typically, multiple chemicals are mixed into these chemical chelating solutions. Current processes require significantly longer application times at narrow band specific temperatures in order to dissolve or mobilize the sludge, corrosion products, and other materials discussed.

The necessary narrow band specific temperatures required by conventional chemical processes need more equipment on site and may involve recirculation of the system to be cleaned with a reactor cooling pump or other mixing device in order to maintain the optimum temperature. The use of multiple chemicals required to optimize the process dissolution or mobilization technology results in additional expense and/or time to either mix the chemicals at an off-site location or the need for sufficient tanks on site to mix the chemicals.

The conventional processes also require 24 hours or longer for dissolving, mobilizing or otherwise treating the sludge, scale, corrosion product or deposits. The longer the system is exposed to the chemical process, the higher the chance for additional corrosion or other challenges that might occur during the process.

SUMMARY OF THE INVENTION

An object of the present invention is to provide a process to remove sludge, scale, corrosion products and other metallic species from system piping, tanks or heat exchangers in nuclear or non-nuclear systems in less time, at lower temperatures and larger quantities than those currently known in the art.

The present invention provides a method for removing corrosion products from a system, the method including: adjusting the system temperature to between 115° F. to 212° F.; injecting a cleaning dissolution solvent into the system; injecting a gas into the system after the system is filled with the cleaning dissolution solvent; the gas mixing with the solvent in the system; draining the solvent from the system after a predetermined period of time of dissolution; injecting a passivation composition into the system; injecting a gas into the system, the gas mixing the passivation composition; draining the system of the composition after a predetermined period of time of passivation; rinsing the system with a low volume solution; and rinsing the system at with a full volume solution.

BRIEF DESCRIPTION OF THE DRAWINGS

One embodiment of the present invention is shown with respect to the drawings in which the figure shows a flow chart of the present invention.

DETAILED DESCRIPTION

There are several chemical steps associated with the present invention. The present corrosion product chemical dissolution process includes the following steps: heatup rinse 2, iron dissolution 4,6, 8, passivation 10, 12, 14, and both low volume 16 and full volume 18 rinses.

Heatup rinse 2 is to adjust the system temperature to meet process conditions, if the system is not already at process conditions. The process temperature condition for the system during the dissolution process is at a temperature above 115° F. and below 212° F. Therefore, if the temperature of the system is lower than 115° F., heat is injected into the system to heat the system to between 115° F. and 212° F. One method of heating the system is to inject a rinse solution to increase the temperature of the system to the optimum temperature for that application. Other heating sources may be utilized such as recirculating the system water through a heating source or steam injection into the system to heat the systems fluids. Additional heating may be supplied during the injection to raise the temperature further to ensure the system reaches the optimum temperature.

Once the correct temperature is reached, the iron dissolution steps 4, 6, 8 begin by injecting a dissolution solvent 4 into the system. Concentrated oxalic acid is blended with demineralized water from a tank during injection into the system. The oxalic acid solution increases the porosity of an iron deposit via dissolution prior to the removal of the solution from the system. The typical concentration is 0.25 to 40 grams per liter of oxalic acid depending on the application objectives. This mixture dissolves, solubilizes and removes the corrosion products or other metallic complexed species. The iron solution can be heated externally from the system to the desired application temperature of between 115° F. to 212° F. A longer contact time may be required for equivalent efficacy when lower temperatures, such as 115° F. are used. The solvent may remain in the system for 30 minutes or less after injection, or for multiple days if the solvent is on a feed and bleed process or if the temperature is in the lower application range.

Once the system is filled with solvent, it can be mixed by an injection of a gas 6. The gas may be nitrogen or some other gas. The gas may be injected intermittently or for the entire time the solvent is in the system. The injection time is system and process objective dependent.

The mixed solution in the system can be re-circulated with pumps or can remain near stagnant and still perform the dissolution process. After the appropriate contact time has elapsed or after the solution has become saturated, the cleaning solvent will be drained 8 from the system.

The iron dissolution steps 4, 6, 8 may be applied more than once in the individual system depending on how much deposit is to be removed and the process objectives.

In order to stabilize the passive layer of deposit on the surface of the system, the dissolution step 4, 6, 8 is followed by a passivation step 10, 12, 14. The passivation step composition is composed of between 5 and 20 grams per liter of hydrogen peroxide plus 0.25 to 20 grams per liter of oxalic acid depending on deposit composition. The passivation composition stabilizes the passive layer of deposit on the carbon steel surface through conversion of the ferrous oxalate to soluble ferric oxalate. The passivation composition also solubilizes some ions in this oxidizing chemistry which are not dissolved in the reducing chemistry conditions of the iron dissolution step 4, 6, 8. The temperature maintained during the application of the passivation step 8, 10 should be below 150° F. for optimum conditions. Temperatures higher than 150° F. may be utilized but the passivation step 10, 12, 14 will not be as effective due to hydrogen peroxide self catalyst destruction. The contact time should be limited to less than twelve hours but may be removed from the system when all of the hydrogen peroxide is depleted. After the injection of the passivation composition 10 into the system, a gas can be injected 12 to mix the solution and clear the injection lines. This gas injection 12 may be as short as 15 minutes or as long as the full duration of the process application, for example up to twelve hours. After twelve hours, or when the hydrogen peroxide is depleted, the system will be drained 14 back to the processing tank.

Due to the design of most systems, there will be some solvent remaining in the system after draining. In order to remove this solvent a minimum of two low volume rinses 16 are performed. The volume of these low volumes rinses will vary depending upon the system being cleaned, but typically the volume will be between 15 to 50 percent of the iron dissolution step 4 volume. After low volume rinse 16, a full volume rinse 18 is performed including filling the system to the same level as the iron dissolution step and passivation step. This rinse solution may remain in the system or be drained.

Once the process has been completed and the chemicals used have been decomposed and the liquid demineralized, the liquid can be reused for second and/or further additions of solvent for residual deposits dissolution. The nominal carbon steel corrosion resulting from performing one or more applications of the present invention, including the passivation composition step 10, is less than 0.005 inches. Each application of this process may remove up to 1000 pounds of sludge, scale and corrosion products or other metallic deposits from the treated surface per step per assumed system volume. Multiple applications of this process can remove an additional 500 to 1,000 pounds with each application per assumed system volume.

The process chemistry that results from the present invention may also be destroyed by wet oxidation resulting in the dissolved deposits reformed into solids during the wet oxidation process. The reformed metal ions are then removed by electrochemical or mechanical separation technology such as filtration, cyclone devices or clarification. The decomposition products of the process chemistry are carbon dioxide ($CO_2$) and water ($H_2O$). The remaining liquid may, but does not have to, be passed through a demineralization column which will result in the remaining liquid to be demineralized and available for reuse as needed.

The pH of the present invention is optimized between 1.0 and 5.5.

What is claimed is:

1. A method for removing corrosion products from a system, the method comprising:

adjusting the system temperature to between 115° F. to 212° F.;

injecting a cleaning dissolution solvent including oxalic acid into the system;

injecting a gas into the system after the system is filled with the cleaning dissolution solvent, the gas mixing with the solvent in the system;

draining the solvent from the system after a predetermined period of time of dissolution;

injecting a passivation composition including oxalic acid into the system;

injecting a gas into the system, the gas mixing the passivation composition, the oxalic acid in the passivation composition converting ferrous oxalate resulting from the cleaning dissolution solvent into ferric oxalate;

draining the system of the composition after a predetermined period of time of passivation;

rinsing the system with a low volume solution after draining the system of the composition; and rinsing the system with a full volume solution.

2. The method as recited in claim 1 wherein the system temperature is adjusted by a pre-cleaning rinse solution.

3. The method as recited in claim 1 wherein the system temperature is adjusted by injection of steam.

4. The method as recited in claim 1 wherein the system temperature is adjusted by recirculation of a solution with an external heater.

5. The method as recited in claim 1 wherein the system temperature is adjusted by recirculation of a primary heat exchanger system with reactor coolant pumps.

6. The method as recited in claim 1 wherein the dissolution solvent is concentrated oxalic acid and demineralized water.

7. The method as recited in claim 6 wherein the demineralized water is heated to 115° F. to 212° F.

8. The method as recited in claim 6 wherein the concentrated oxalic acid is between 0.25 to 40 grams per liter.

9. The method as recited in claim 1 wherein the predetermined period of time of dissolution is 30 minutes or less.

10. The method as recited in claim 1 wherein the dissolution solvent is introduced into the system as concentrated solution which is diluted by an injection solution.

11. The method as recited in claim 1 wherein the predetermined period of time of dissolution 24 hours or less.

12. The method as recited in claim 1 wherein the gas is compressed air.

13. The method as recited in claim 1 wherein the gas is nitrogen.

14. The method as recited in claim 1 wherein the gas is injected into the system for at least 15 minutes.

15. The method as recited in claim 1 further comprising after draining the solvent, repeating the injecting of a dissolution solvent into the system, injecting a gas in the system after the system is filled with dissolution solvent, the gas mixing the solvent in the system, and draining the solvent from the system after an additional predetermined period of time of dissolution.

16. The method as recited in claim 1 wherein the passivation composition comprises between 5 to 20 grams per liter of hydrogen peroxide and 0.25 to 20 grams per liter of oxalic acid.

17. The method as recited in claim 1 further comprising a step of maintaining the system temperature 150° F. or less when the passivation composition is present.

18. The method as recited in claim 1 wherein the predetermined period of time of passivation is less than 12 hours.

19. The method as recited in claim 1 wherein the passivation composition further includes hydrogen peroxide and the predetermined period of time of passivation is selected so that the passivation composition is in contact with the system until all of the hydrogen peroxide is depleted from the passivation composition.

20. The method as recited in claim 1 wherein the low volume rinse volume is equal to 15 to 50 percent of the dissolution solvent volume.

21. The method as recited in claim 1 wherein the full volume rinse volume is equal to the volume of the dissolution solvent and the passivation solution.

22. The method as recited in claim 1 wherein the pH of the system is maintained between 1.0 and 5.5.

23. The method as recited in claim 1 wherein the system is a nuclear power plant.

* * * * *